US007262710B2

(12) United States Patent
Watanabe et al.

(10) Patent No.: US 7,262,710 B2
(45) Date of Patent: Aug. 28, 2007

(54) COLLISION TIME ESTIMATION APPARATUS FOR VEHICLES, COLLISION TIME ESTIMATION METHOD FOR VEHICLES, COLLISION ALARM APPARATUS FOR VEHICLES, AND COLLISION ALARM METHOD FOR VEHICLES

(75) Inventors: Seigo Watanabe, Yokohama (JP); Rumiko Oshima, Zama (JP); Masahiko Sakamoto, Atsugi (JP)

(73) Assignee: Nissan Motor Co., Ltd., Kanagawa-Ken (JP)

( * ) Notice: Subject to any disclaimer, the term of this patent is extended or adjusted under 35 U.S.C. 154(b) by 201 days.

(21) Appl. No.: 11/216,168

(22) Filed: Sep. 1, 2005

(65) Prior Publication Data

US 2006/0062432 A1 Mar. 23, 2006

(30) Foreign Application Priority Data

Sep. 22, 2004 (JP) ..... P2004-275039
Sep. 24, 2004 (JP) ..... P2004-278504

(51) Int. Cl.
*G08G 1/16* (2006.01)

(52) U.S. Cl. ..... 340/903; 340/937; 340/436

(58) Field of Classification Search ..... 340/903, 340/937, 938, 435, 436; 701/28, 96, 117, 701/301; 382/104, 106; 348/135, 142
See application file for complete search history.

(56) References Cited

U.S. PATENT DOCUMENTS 6,246,961 B1 6/2001 Sasaki et al.
6,477,260 B1 * 11/2002 Shimomura ..... 382/106
6,714,139 B2 * 3/2004 Saito et al. ..... 340/903
6,990,216 B2 * 1/2006 Yamamura ..... 382/106

FOREIGN PATENT DOCUMENTS

JP 11-353565 12/1999

OTHER PUBLICATIONS

Dagan, Erez., et al. "Forward collision warning with a single camera." Intelligent Vehicle Symposium, 2004 IEEE, Parma Italy, Jun. 14-17, 2004, Piscataway, NJ, USA, IEEE, Jun. 14, 2004, pp. 37-42, XP010727439.

* cited by examiner

*Primary Examiner*—Van T. Trieu
(74) *Attorney, Agent, or Firm*—McDermott Will & Emery LLP

(57) ABSTRACT

Imaging device picks up an image of the area around a vehicle, edge extraction function extracts an edge image from the image picked up by the imaging device, edge width standardization function standardizes an edge width of the edge image extracted by the edge extraction function, counting functions increments a count value corresponding to a position where the edge image standardized by the edge width standardization function is detected, and also initializes a count value corresponding to a position where the standardized edge image is not detected, moving speed detection function calculates a moving direction and moving speed of the edge image extracted by the edge extraction function based on the inclination of the count values, and collision time calculation function calculates the time of collision with an object by utilizing the position and the moving speed of the edge image calculated by the moving speed detection function.

13 Claims, 10 Drawing Sheets

COUNTED VALUE (COUNT)
INCREMENT
EDGE POSITION SHIFTED INCREMENT
$x_0-1$
$x_0$
$x_0+1$
H
h
Y

FIG. 12A
FIG. 12B
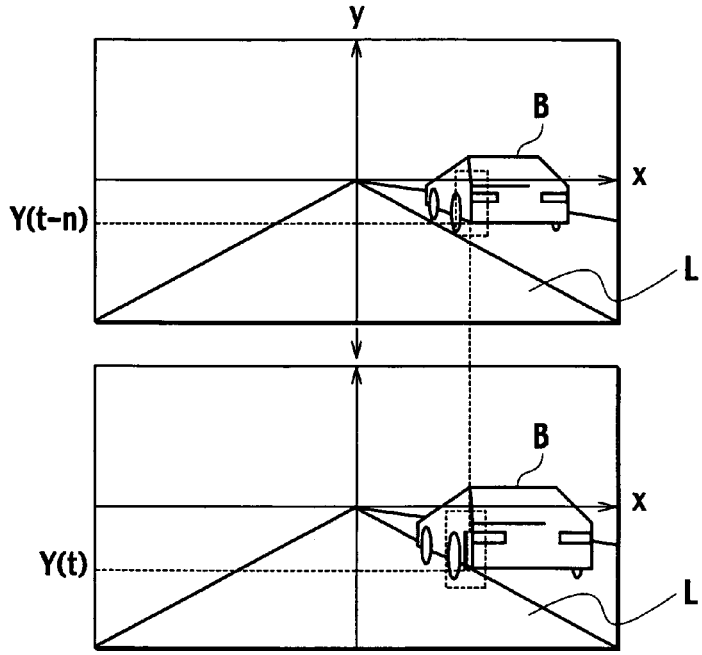
FIG. 13A
FIG. 13B
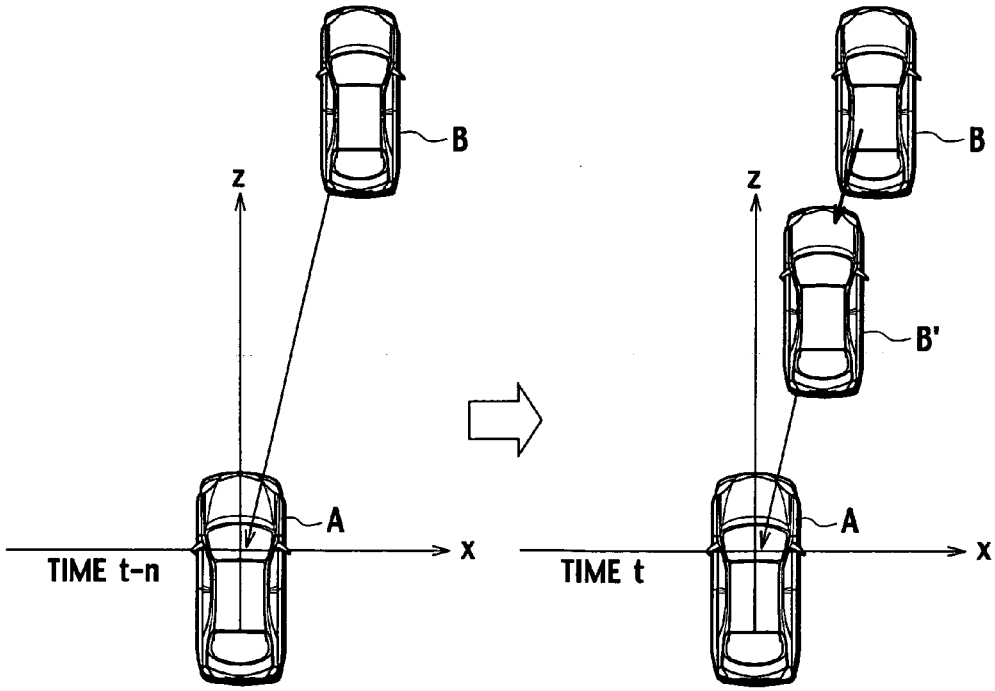

FIG. 14
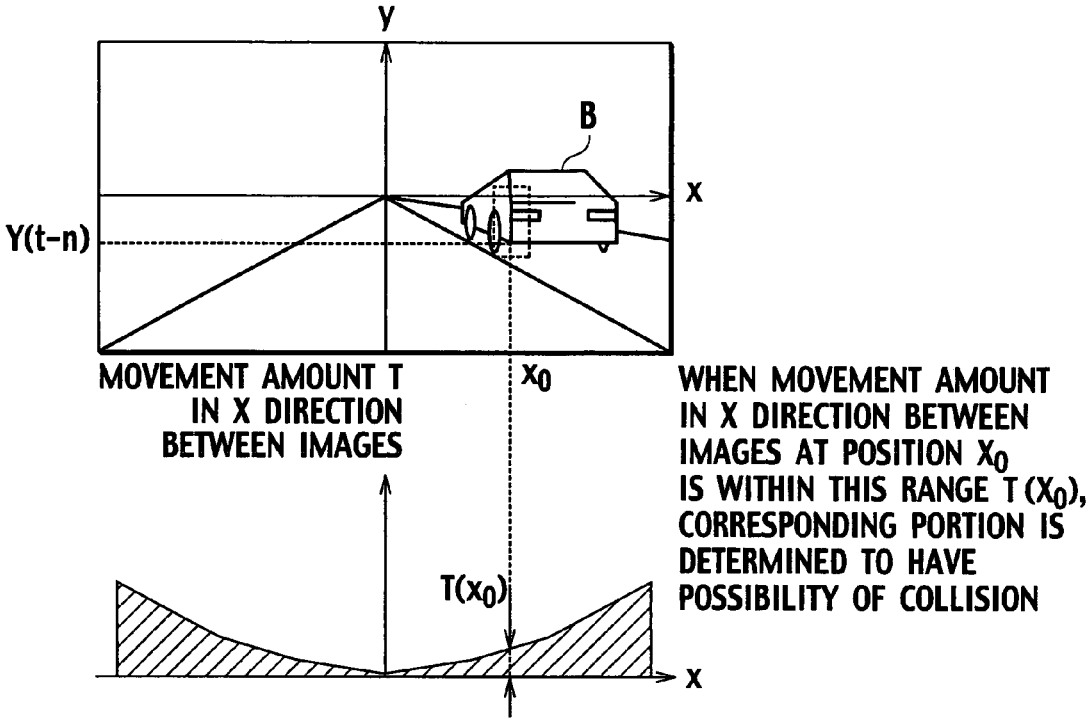
FIG. 15A
FIG. 15B
FIG. 15C
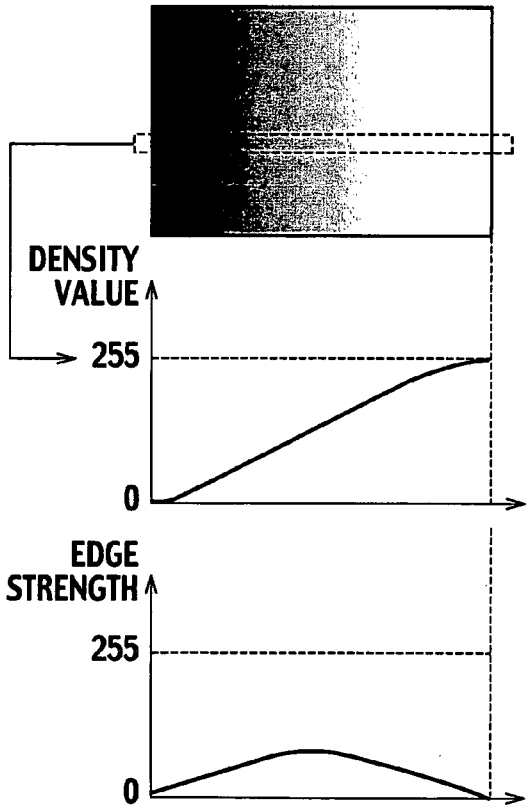

FIG. 16A
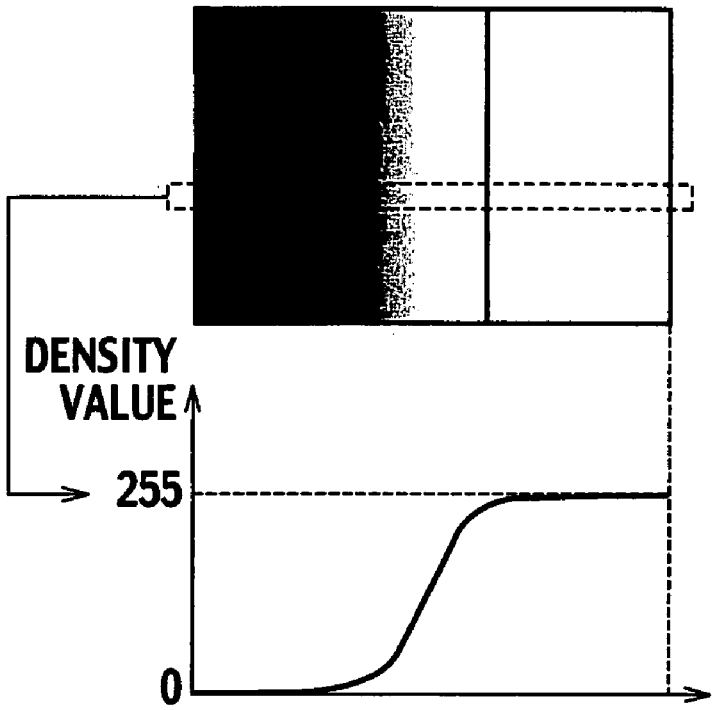
FIG. 16B
FIG. 16C
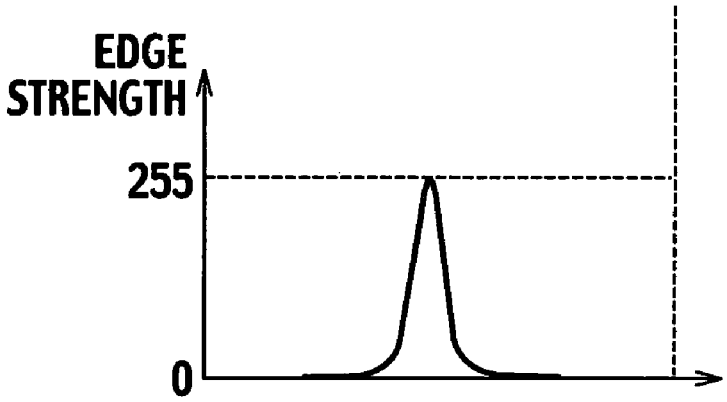

COLLISION TIME ESTIMATION APPARATUS FOR VEHICLES, COLLISION TIME ESTIMATION METHOD FOR VEHICLES, COLLISION ALARM APPARATUS FOR VEHICLES, AND COLLISION ALARM METHOD FOR VEHICLES

BACKGROUND OF THE INVENTION

The present invention relates to a collision time estimation apparatus for vehicles that is provided in a vehicle and estimates the time of collision with an object, and also to a collision time estimation method for vehicles. The present invention further relates to a collision alarm apparatus and a collision alarm method for vehicles that estimate the time of collision with an object having the possibility of collision with a subject vehicle, and based on the estimation result, raise an alarm of the possible collision for a driver or control the vehicle in order to avoid the collision with the object.

As disclosed in Japanese Patent Application Laid-Open No. H11-353565, conventionally, there is a collision time estimation apparatus for vehicles that detects horizontal or vertical edges of an object having the possibility of collision, from two images of surrounding areas of a vehicle which are picked up at different times, then calculates an optical flow of the detected edges using a correlation method, and estimates the time of collision with an object based on the calculated optical flow. According to such a collision time estimation apparatus for vehicles, an alarm raised based on the estimated collision time can make a driver take an action for avoiding the collision with the object.

Further, as disclosed in Japanese Patent Application Laid-Open No. H11-353565, conventionally, there is also a collision alarm apparatus for vehicles that detects horizontal or vertical edges of an object, from two images of surrounding areas of a vehicle which are picked up at different times, then calculates an optical flow of the detected edges, subsequently determines the possibility of collision with the object around the vehicle by further calculating the time of collision with the object based on the calculated optical flow, and finally raises an alarm. According to such a collision alarm apparatus for vehicles, an action for avoiding the collision with the object can be taken by a driver.

The above correlation method is a block matching algorithm of dividing an image into a plurality of areas and finding similar areas from temporally successive images. In this algorithm, when a noticeable area within the frame at time t is represented as I (x, y, t) and an area within the frame temporally successive to the frame at time t and corresponding to the noticeable area I (x, y, t) is represented as I (x+u, y+v, t+1), (u, v) to minimize the value of $\Sigma\Sigma\{I(x, y, t)-I(x+u, y+v, t+1)\}^2$ and the value of $\Sigma\Sigma|I(x, y, t)-I(x+u, y+v, t+1)|$ is detected as an optical flow of an object between the successive frames.

SUMMARY OF THE INVENTION

When an optical flow is detected by using the correlation method, however, the computational complexity increases because a region to calculate a correlation value is provided around a noticeable area and a brightness correlation value within the region between two frames of different times is detected, and therefore the collision time cannot be calculated easily. Furthermore, since a corresponding position within an image is detected before calculation of edge speed within the image, the positioning accuracy of the edge within the image exerts a direct influence on the estimation accuracy of the collision time. This means that, when an error occurs in detection of edge position, the movement amount of the edge may contain this error.

The conventional collision alarm apparatus is configured under a condition that an object is running in parallel with a forward direction of a subject vehicle (Z axis in a vehicle coordinate system), such as when an object running straight on an adjacent lane of a subject vehicle is overtaking the subject vehicle or when an object is approaching from the front of a subject vehicle in parallel to an advancing direction thereof. Therefore, according to the conventional collision alarm apparatus for vehicles, when an object which leads the subject vehicle to dangerous situations, such as an object suddenly coming in right ahead, cutting in, or merging, moves in a lateral direction of the subject vehicle, it is not possible to determine whether the collision time is calculated for an object having the possibility of collision with the subject vehicle, and thus the collision time cannot be calculated properly.

The present invention is achieved in order to solve the above problem, and it is an object of the present invention to provide a collision time estimation apparatus and a collision time estimation method for vehicles that facilitate calculation of the collision time and can obtain robust output against errors in position detection. Another object of the present invention is to provide a collision alarm apparatus and a collision alarm method for vehicles that can properly calculate the time of collision with an object, which has a possibility of collision with a subject vehicle.

In order to solve the above problem, the collision time estimation apparatus and the collision time estimation method for vehicles according to the present invention standardize an edge width of an edge image, increment a count value corresponding to a position where the standardized edge image is detected as well as initialize a count value corresponding to a position where the standardized edge image is not detected, calculate a moving direction and moving speed of the edge image based on an inclination of the count values, and calculate the time of collision with an object by utilizing the calculated position and moving speed of the edge image. According to the collision time estimation apparatus and the collision time estimation method for vehicles of the present invention, the moving speed of an edge image and the collision time can be calculated without performing block matching such as template matching, so that the calculation of collision time is facilitated and robust output against errors in position detection can be obtained.

Furthermore, the collision alarm apparatus and the collision alarm method for vehicles according to the present invention extract a longitudinal edge image and a lateral edge image from the picked up image, calculate the movement amount of the longitudinal edge image and the lateral edge image, extract an image area containing an object having a possibility of collision as a noticeable area according to the calculation result of the movement amount, and calculate the time of collision with the object by utilizing the longitudinal position and the moving speed of the lateral edge image which is contained in the extracted noticeable area. According to the collision alarm apparatus and the collision alarm method for vehicles of the present invention, an image area containing an object having the possibility of collision is extracted based on the movement amount of the longitudinal and lateral edge images, and the collision time is calculated only for this object, so that only the time of collision with an object, which has a possibility of collision with a subject vehicle, can be calculated properly.

BRIEF DESCRIPTION OF THE DRAWINGS

FIGS. 12A and 12B are explanatory views for noticeable area setting processing of noticeable area setting means shown in FIG. 9;

FIGS. 13A and 13B are explanatory views for the noticeable area setting processing of the noticeable area setting means shown in FIG. 9;

FIG. 14 is an explanatory diagram for the noticeable area setting processing of the noticeable area setting means shown in FIG. 9;

FIGS. 15A to 15C are diagrams showing density distribution of an edge image when edge strength is low; and FIGS. 16A to 16C are diagrams showing density distribution of an edge image when edge strength is high.

DETAILED DESCRIPTION OF THE PREFERRED EMBODIMENTS

With reference to the accompanying drawings, configurations of a collision time estimation apparatus for vehicles and a collision alarm apparatus for vehicles according to the preferred embodiments of the present invention will be described below.

Configuration of Collision Time Estimation Apparatus for Vehicles

Figure 1:
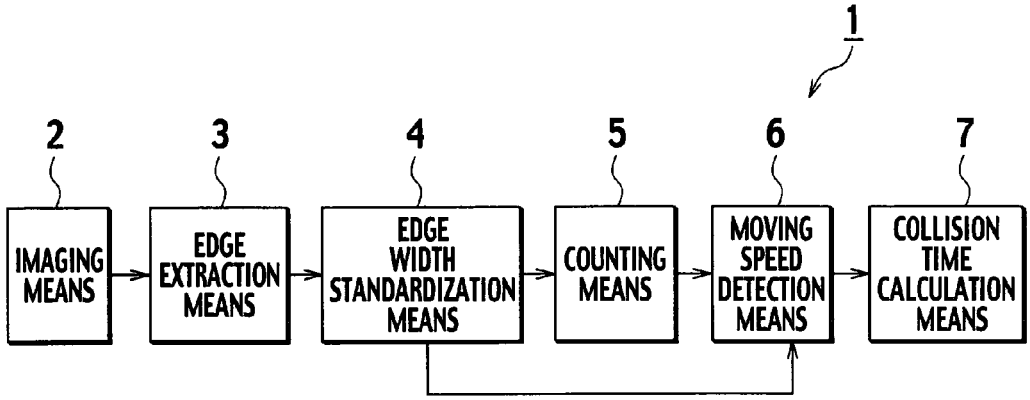
FIG. 1 is a block diagram showing a configuration of a collision time estimation apparatus for vehicles according to an embodiment of the present invention.

A collision time estimation apparatus for vehicles 1 according to an embodiment of the present invention is provided in a vehicle and includes, as shown in FIG. 1, imaging means 2 for picking up an image of the area around a vehicle, edge extraction means 3 for extracting an edge image, by using a Sobel filter, from temporally successive images picked up by the imaging means 2, edge width standardization means 4 for standardizing the edge width of the edge image extracted by the edge extraction means 3 to a predetermined number of pixels, counting means 5 for storing, as a count-up mask 14 (see FIG. 2), information as to over how many frames the standardized edge image is observed successively, moving speed detection means 6 for calculating the moving speed and the moving direction of the edge image by using the count-up mask 14, and collision time calculation, means 7 for calculating the time-to-collide (TTC) with an object which has a risk of collision, using the position and the moving speed of the edge image.

The imaging means 2 includes pickup elements such as CMOS or CCD, and is mounted on at least one of the front end, the rear end, and the side face of a vehicle, or on the position where the time of collision with an object, which has a risk of collision, should be measured accurately. Furthermore, the imaging means 2 obtains an image of the area around a vehicle at a frame rate higher than a predetermined value, which is faster than the moving speed of the edge image, so as to facilitate calculations of the moving speed and the moving direction of the edge image (the details thereof is described later).

Figure 2:
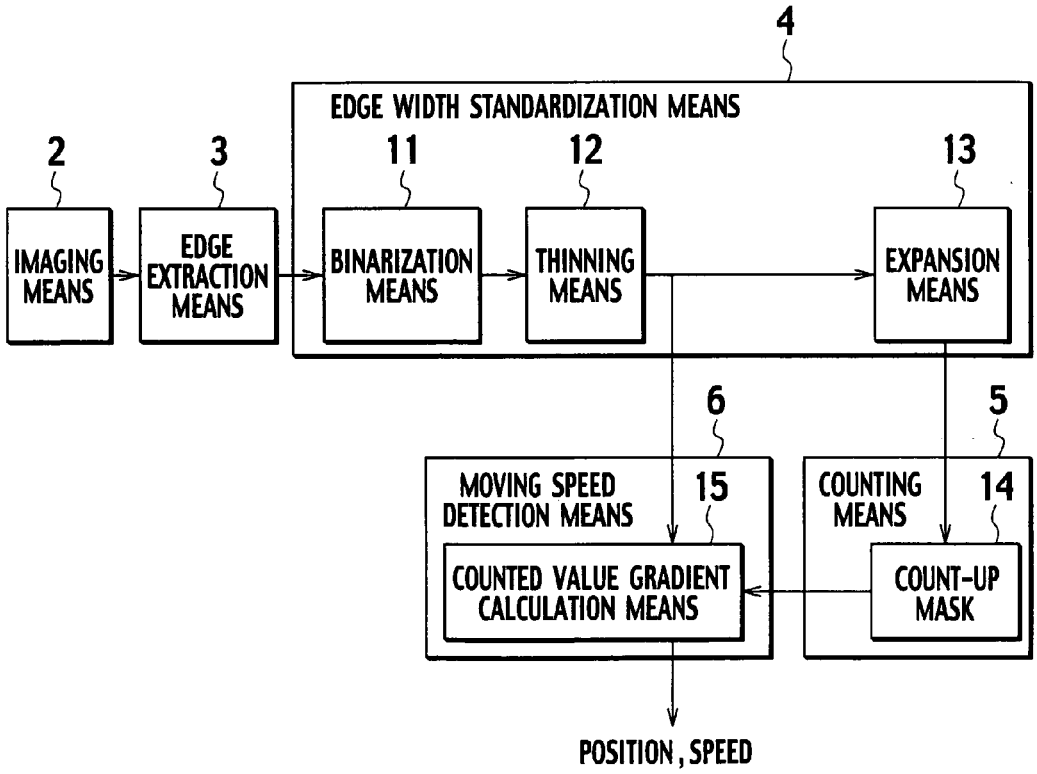
FIG. 2 is a block diagram showing internal configurations of edge width standardization means, counting means, and moving speed detection means which are shown in FIG. 1.

The edge width standardization means 4 includes, as shown in FIG. 2, binarization means 11, thinning means 12, and expansion means 13. The moving speed detection means 6 includes counted value gradient calculation means 15. Functions of each of the edge extraction means 3, edge width standardization means 4, counting means 5, moving speed detection means 6, and collision time calculation means 7 are implemented when a computer program is executed by an in-vehicle computer.

The collision time estimation apparatus for vehicles 1 thus configured facilitates calculation of the collision time and also allows acquisition of robust output against errors in position detection by executing the following collision time calculation processing. With reference to the flowchart shown in FIG. 3, internal operations of the collision time estimation apparatus 1, at the time of executing the collision time calculation processing, will be explained.

Figure 3:
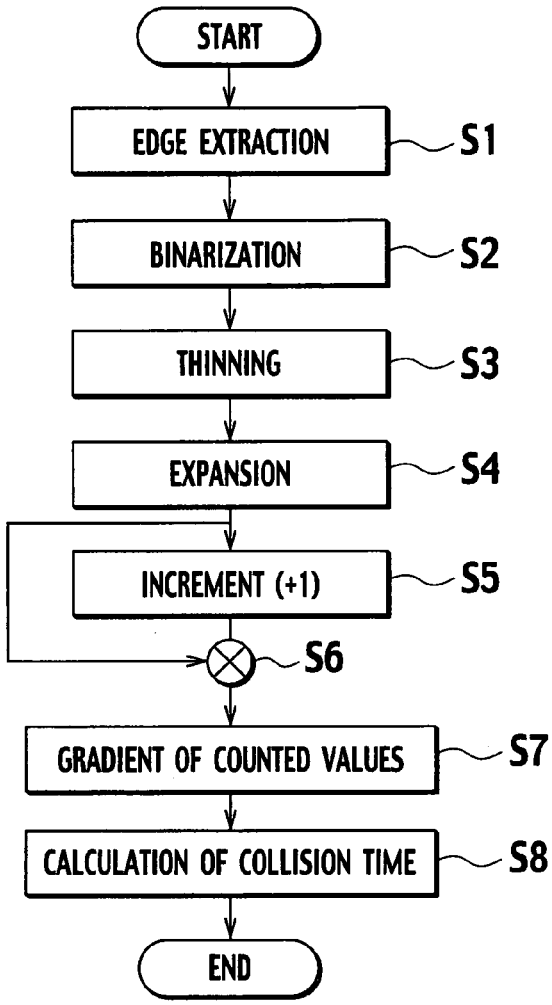
FIG. 3 is a flowchart showing a collision time calculation processing flow according to the embodiment of the present invention.

The flowchart shown in FIG. 3 starts when the imaging means 2 obtains an image of the area around a vehicle at a predetermined frame rate and then inputs the obtained image of the area around the vehicle to the edge extraction means 3. The collision time calculation processing then proceeds to step S1.

At step 1, the edge extraction means 3 extracts an edge image in lateral and longitudinal directions, by using a Sobel filter, from the image of the area around the vehicle picked up by the imaging means 2. The processing at step S1 is then completed, whereupon the calculation processing proceeds to step S2.

Figure 4A:
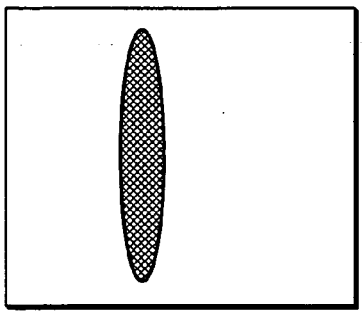
FIGS. 4A to 4C are diagrams for explaining standardization processing of the edge width standardization means shown in FIG. 1.

At step S2, as shown in FIG. 4A, the binarization means 11 executes binarization processing (0/1) to the edge image in lateral and longitudinal directions extracted at step S1. The processing at step S2 is then completed, whereupon the calculation processing proceeds to step S3.

Figure 4B:
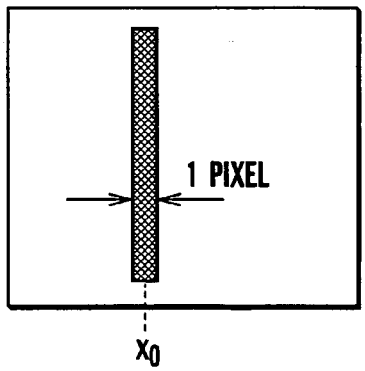

At step S3, as shown in FIG. 4B, the thinning means 12 thins the active (the value of 1) edge image to a predetermined pixel width (one pixel in the example shown in FIG. 4B). The thinning means 12 executes the thinning processing repetitively until the edge width reaches the predetermined pixel width. The processing at step S3 is then completed, whereupon the calculation processing proceeds to step S4.

Figure 4C:
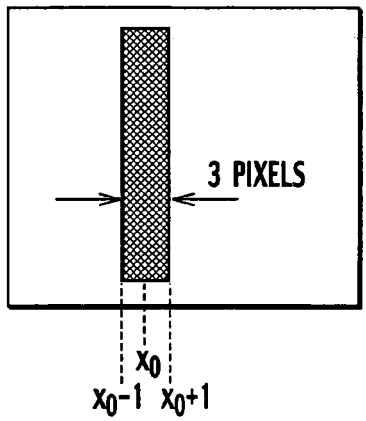

At step S4, the expansion means 13 expands the edge image to a predetermined pixel width. Specifically, when the edge image is observed at the position x0 as shown in FIG. 4B as a result of thinning the edge image, the expansion means 13 sets pixels at the position x0−1 and the position x0+1 which are at both sides of the position x0 to an active state, so as to expand the edge image to the predetermined pixel width as shown in FIG. 4C (three pixels in the example of FIG. 4C). The processing at step S4 is then completed, whereupon the calculation processing proceeds to step S5.

Figures 5A, 5B, 5C:
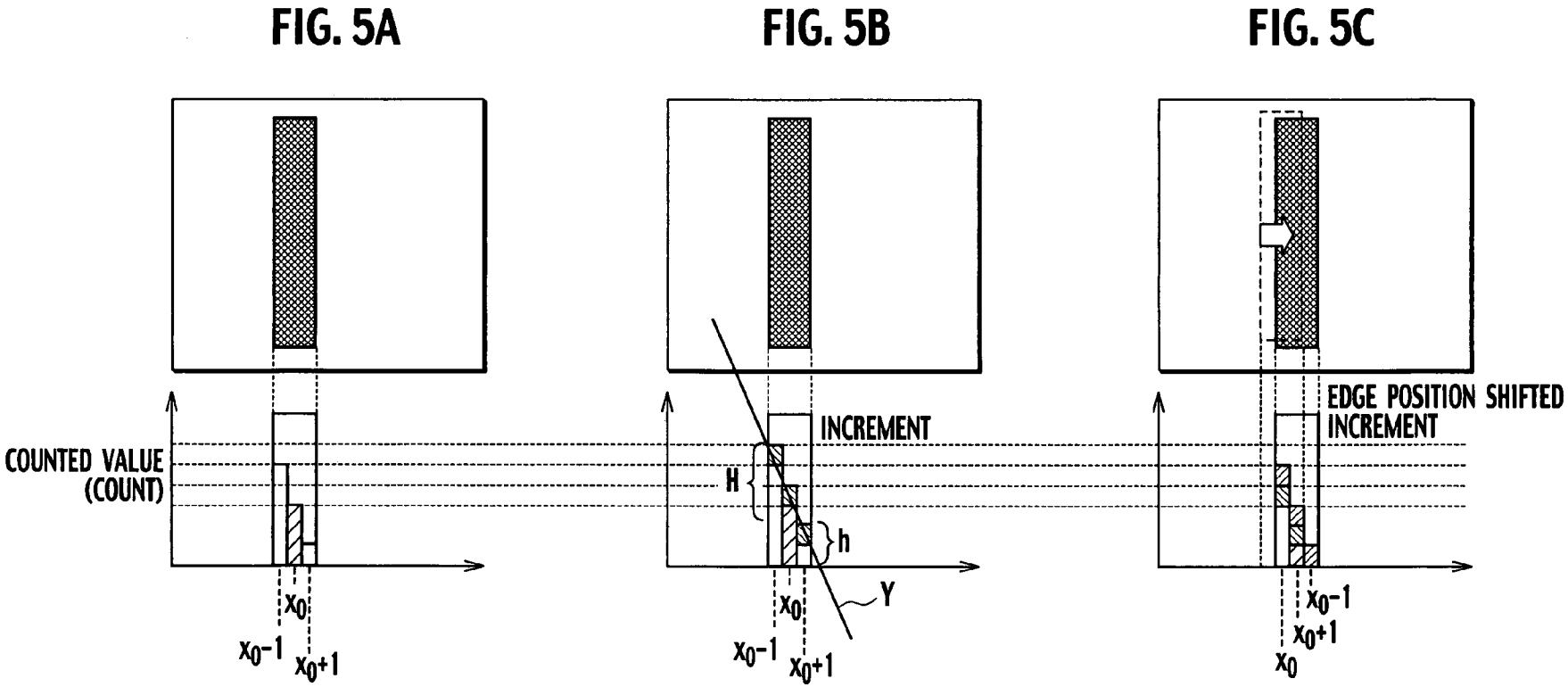
FIGS. 5A to 5C are diagrams for explaining counting processing of the counting means shown in FIG. 1.
Figures 6A, 6B:
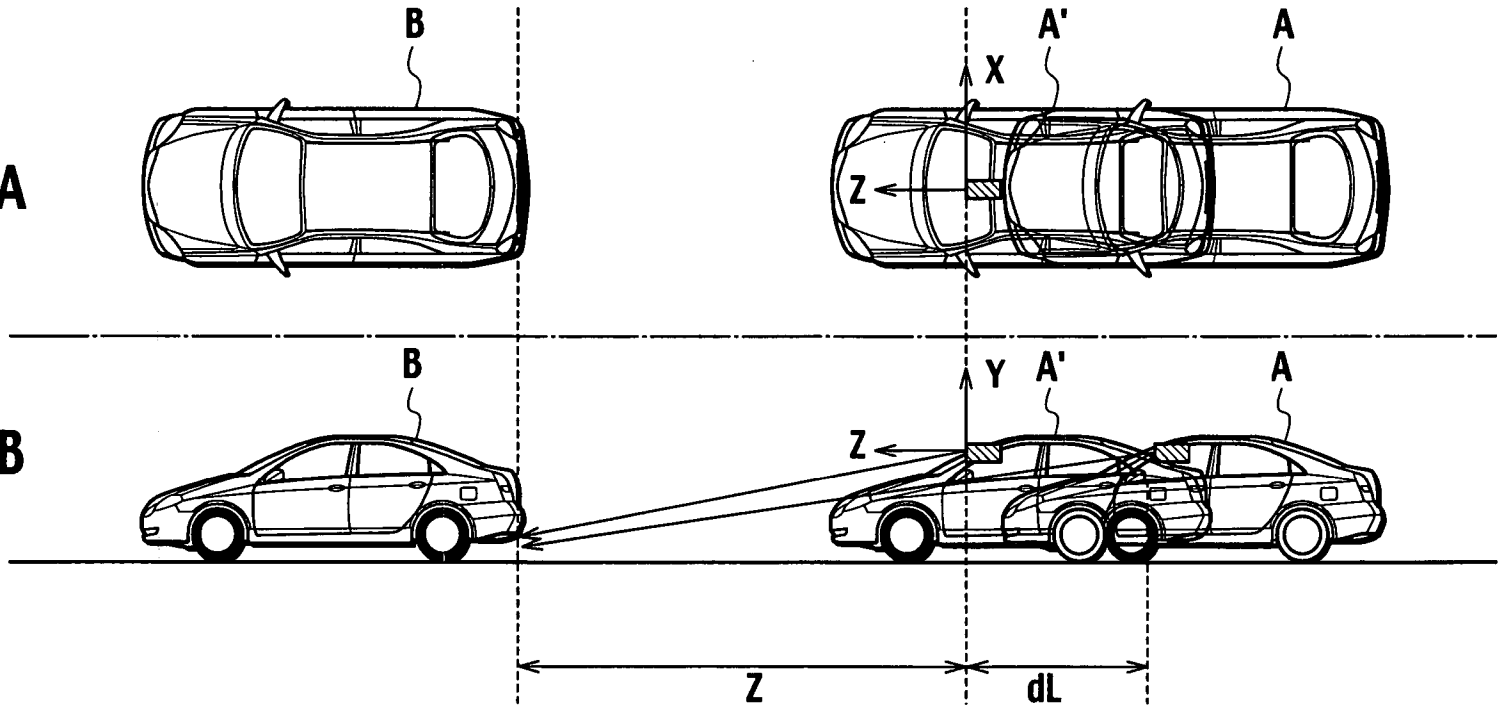
FIGS. 6A and 6B are explanatory views for the collision time calculation processing of collision time calculation means shown in FIG. 1.
Figure 7A:
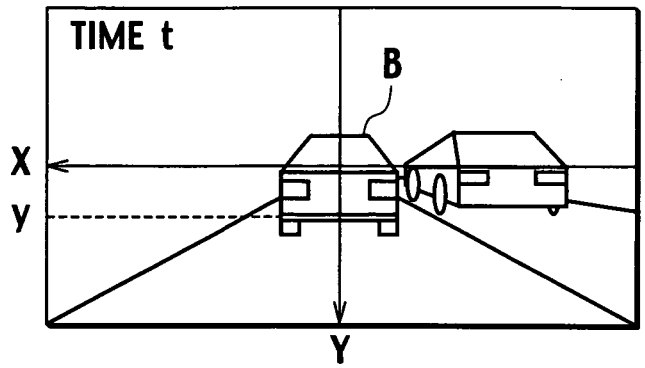
FIGS. 7A and 7B are explanatory diagrams for the collision time calculation processing of the collision time calculation means shown in FIG. 1.
Figure 7B:
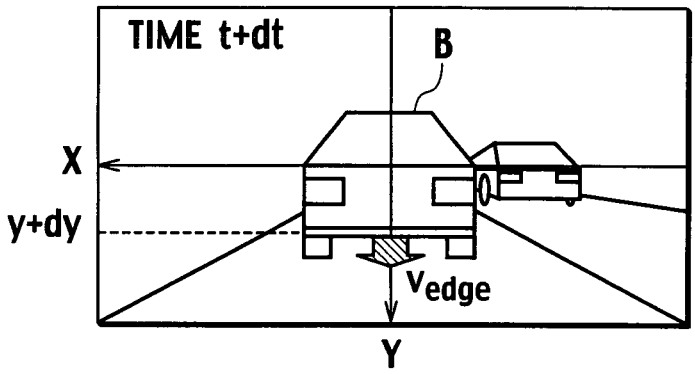

At steps S5 and S6, the counting means 5 increments the value of a memory address (count value) corresponding to a position at which the standardized edge image is observed (step S5), and also resets to 0 the value of a memory address corresponding to a position at which the standardized edge image is not observed (step S6). Specifically, when the edge image shown in FIG. 4C is detected at time t, the counting means 5 increments by 1 each of the count values of the positions x0−1, x0, and x0+1 at which the standardized edge image is detected, and also resets the count values of other positions to 0, as shown in FIG. 5A. The pixel width described in FIGS. 4A-4C and FIGS. 5A-5C (1 pixel, 3 pixels) is merely example, and the present invention is not limited to these values.

Next, when the edge image is observed at the position x0 at time t+1, the counting means 5 further increments by 1 each of the count values of the positions x0−1, x0, and x0+1 at which the edge image is detected, and also resets the count values of other positions to 0, as shown in FIG. 5B. Next, when the edge image is shifted by one pixel in an x-axis direction and observed at the position x0+1 at time t+2, the counting means 5 increments by 1 each of the count values of the positions x0, x0+1, and x0+2 at which the edge mage is detected, and also resets the count values of other positions to 0, as shown in FIG. 5C. The processing at steps S5 and S6 is then completed, whereupon the calculation processing proceeds to step S7.

When the frame rate is sufficiently high as compared to the moving speed of the edge image, the edge image always has an area overlapping among successive frames (overlapping over two pixels in the example shown in FIGS. 5A to 5C). Therefore, by incrementing the count value of the position at which the edge image is observed as described above, the count value becomes equivalent to time during which the edge image is observed at the same position. When the edge image is moved, the count value of the position at which the edge image is newly observed is 1, which is the smallest of the counted values of the edge image. That is, the count value of the edge image becomes small in the moving direction thereof and becomes large in the opposite direction. Accordingly, a gradient produced by differences between those count values, that is, an inclination $\alpha$ of a straight line Y shown in FIG. 5B, is equivalent to the value representing over how many frames the edge image is successively observed at the same position while it moves, in other words, the reciprocal of the moving speed $v_{edge}$ of the edge image as shown by the following expression (1).

$$v_{edge}=1/\alpha \tag{1}$$

More specifically, in the example shown in FIG. 5B, when the count values of the positions x0−1, x0, and x0+1 are 6, 4, and 2, respectively, it can be seen that the edge image is observed each time it shifts over four successive frames (H=6−2=4), which is a difference between the count value at the position x0−1 and the count value at the position x0+1. When the edge image shifts to the position x0, it can be seen that the edge image is observed successively over two frames since the counted value h of the position x0+1 is 2. Accordingly, it can be understood that a noticeable edge image moves by one pixel over four frames, so that the moving speed of the edge image can be detected. Furthermore, it can be assumed that the edge image is moving at constant speed when the frame rate is sufficiently high. Therefore in the example shown in FIGS. 5A to 5C, it can be seen that the edge image shifts by 2 frames/{4 frames/1 pixel}=0.5 pixel from the position x0 at time t+1, because the edge image moves by one pixel over four frames and is observed successively over two frames at time t+1.

At step S7, the counted value gradient calculation means 15 calculates the gradient $\alpha$ of the count values thereby calculating the reciprocal of the moving speed $v_{edge}$ of the edge image. The processing at step S7 is then completed, whereupon the calculation processing proceeds to step S8.

At step S8, the collision time calculation means 7 calculates the time of collision with an object which has a risk of collision, based on the position and the moving speed of the edge image. Specifically, as shown in FIGS. 6A, 6B, 7A, and 7B, when the positions of the edge image detected at time t and time t+dt are represented as y and y+dy, respectively, and the distance traveled by a subject vehicle A between time t and time t+dt is represented as dL, a distance Z between the subject vehicle A and another vehicle B at time t+dt can be represented by the following expression (2). Furthermore, the moving speed $v_{edge}$ in y direction (vertical direction) of the edge image and the relative speed $V_{vehicle}$ of the other vehicle B to the subject vehicle A are represented by the following expressions (3) and (4), respectively.

$$Z = \frac{y}{dy} \cdot dL = \frac{y}{\left(\frac{dy}{dt}\right)} \cdot \frac{dL}{dt} \tag{2}$$

$$v_{edge} = \left(\frac{dy}{dt}\right) \tag{3}$$

$$V_{vehicle} = \frac{dL}{dt} \tag{4}$$

Accordingly, the distance Z between the subject vehicle A and the other vehicle B at time t+dt is represented by the following expression (5) by substituting the expressions (3) and (4) for the expression (2). Therefore the time-to-collide (TTC) with the other vehicle B can be calculated by substituting the position y and the moving speed $v_{edge}$ (or gradient $\alpha$ of the count values) of the edge image at time t for the following expression (6). That is, there is no need to calculate the accurate distance to the other vehicle B and the relative speed thereto, and the time-to-collide (TTC) with the other vehicle B is calculated by deriving the time when the distance to the other vehicle B becomes zero. The processing at step S8 is then completed, whereupon a series of the calculation processing steps end.

$$Z = \frac{y}{v_{edge}} \cdot V_{vehicle} \tag{5}$$

$$TTC = \frac{Z}{V_{vehicle}} = \frac{y}{v_{edge}} = y \cdot \alpha \tag{6}$$

Figure 8A:
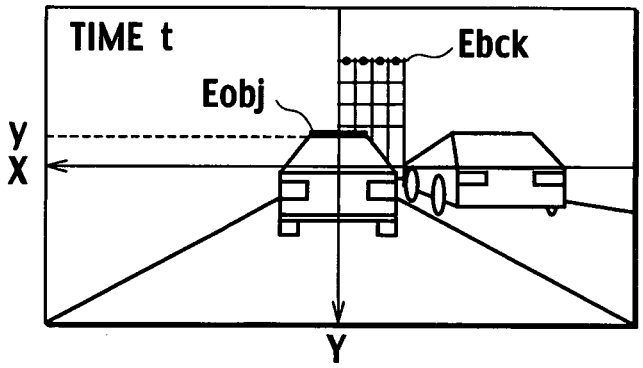
FIGS. 8A and 8B are explanatory diagrams for object classification processing of the collision time calculation means shown in FIG. 1.
Figure 8B:
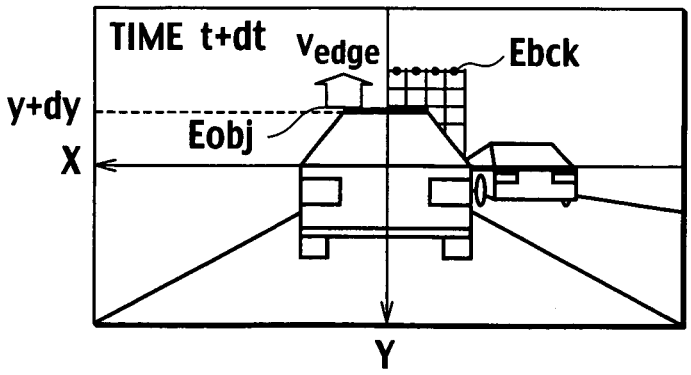

According to the above calculation processing, since the collision time can be calculated at each point of an edge image, the collision time calculation means 7 can separate an object edge Eobj and a background edge Ebck from each other in the edge image according to the collision time calculated for each point as shown in FIG. 8. Specifically, in general, the collision time calculated for the background edge Ebck which is far from a subject vehicle becomes longer, and in contrast, the collision time calculated for the object edge Eobj which is approaching the subject vehicle becomes shorter. Accordingly, the collision time calculation means 7 can classify edges involved with an object according to the length to the collision time. Note that the time of collision with an object traveling at the same speed as a subject vehicle in parallel therewith or an object traveling away from the subject vehicle becomes longer, so the collision time calculation means 7 does not need to classify those objects correctly.

As is clear from the above description, in the collision time estimation apparatus for vehicles 1 according to the embodiment of the present invention, the imaging means 2 picks up an image of the area around a vehicle, the edge extraction means 3 extracts an edge image from the image picked up by the imaging means 2, the edge width standardization means 4 standardizes the edge width of the edge image extracted by the edge extraction means 3, the counting means 5 increments the count value corresponding to the position at which the edge image standardized by the edge width standardization means 4 is detected, and also initializes the count value corresponding to the position at which the edge image standardized by the edge width standardization means 4 is not detected, the moving speed detection means 6 calculates the moving direction and moving speed of the edge image extracted by the edge extraction means 3 based on the inclination of the count values, and the collision time calculation means 7 calculates the time of collision with an object by utilizing the position and the moving speed of the edge image calculated by the moving speed detection means 6. According to this configuration, the moving speed of the edge image and the collision time can be calculated without performing block matching such as template matching, which facilitates the calculation of the collision time and makes it possible to obtain robust outputs against errors in position detection.

According to the collision time estimation apparatus for vehicles 1 in the embodiment of the present invention, the imaging means 2 is mounted on at least one of the front end, the rear end, and the side face of a vehicle, or on the position where the time of collision with an object should be calculated accurately. Therefore, the collision time calculated when the imaging means 2 is mounted to the offset position from the both ends of a vehicle is not influenced by the position of the imaging means 2.

Furthermore, according to the collision time estimation apparatus for vehicles 1 in the embodiment of the present invention, the collision time calculation means 7 can classify objects within an image based on the calculated collision time, so that a background object detected at almost the same position as an object having a risk of collision, can be eliminated.

While an edge width is standardized by executing thinning and expanding processing in the above embodiment, it is also allowable to detect the position of an edge peak of an edge image and then generate a binary image having a width of a predetermined number of pixels at the detected position of the edge peak, in order to standardize the edge width.

Configuration of Collision Alarm Apparatus for Vehicles

Figure 9:
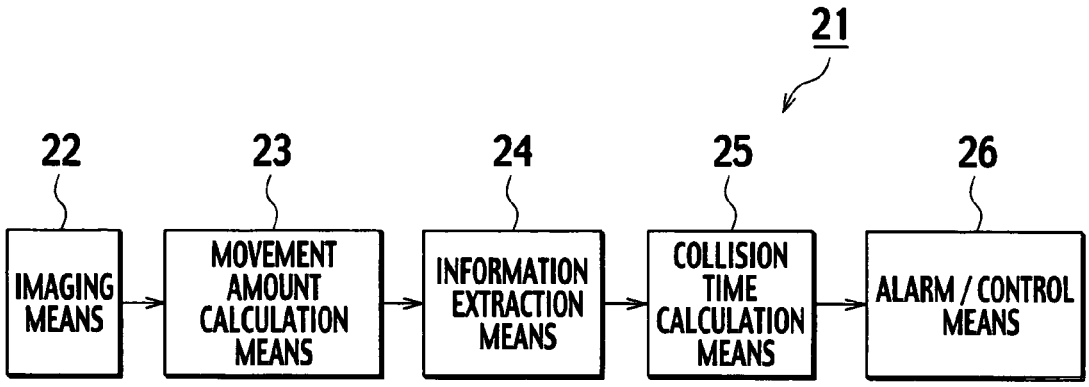
FIG. 9 is a block diagram showing a configuration of a collision alarm apparatus for vehicles according to the embodiment of the present invention.

A collision alarm apparatus for vehicles 21 according to the embodiment of the present invention is provided in a vehicle and includes, as shown in FIG. 9, imaging means 22 for picking up an image of the area around a vehicle, movement amount calculation means 23 for calculating the amount of movement of each region in temporally successive images picked up by the imaging means 22, information extraction means 24 for specifying and extracting a region having a predetermined amount of movement according to the calculation result of the movement amount calculation means 23, collision time calculation means 25 for calculating the collision time between the vehicle and the region extracted by the information extraction means 24 according to the calculation result of the movement amount calculation means 23, and alarm/control means 26 for raising an alarm to alert a driver to a possible collision or controlling a vehicle actuator to avoid the possible collision based on the calculation result of the collision time calculation means 25.

Figure 10:
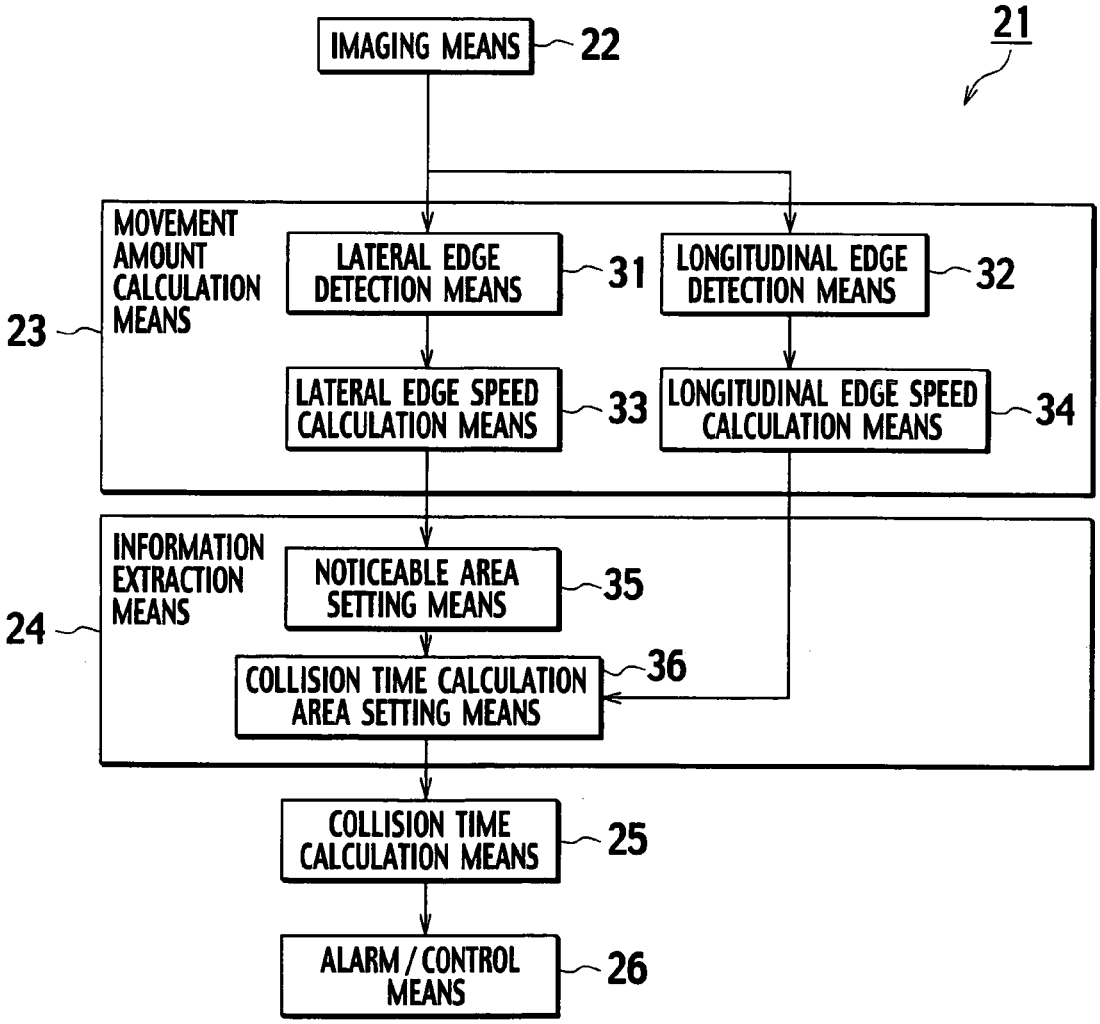
FIG. 10 is a block diagram showing internal configurations of movement amount calculation means and information extraction means which are shown in FIG. 9.

The imaging means 22 has the same configuration as the imaging means 2 of the collision time estimation apparatus for vehicles 1. The movement amount calculation means 23 includes, as shown in FIG. 10, lateral edge detection means 31, longitudinal edge detection means 32, lateral edge speed calculation means 33, and longitudinal edge speed calculation means 34. The information extraction means 24 includes noticeable area setting means 35 and collision time calculation area setting means 36. Functions of the movement amount calculation means 23, the information extraction means 24, the collision time calculation means 25, and the alarm/control means 26 are implemented when a computer program is executed by an in-vehicle computer.

The collision alarm apparatus for vehicles 21 thus configured efficiently calculates only the time of collision with an object, which has a possibility of collision with a subject vehicle, by executing the following collision time calculation processing. With reference to the flowchart shown in FIG. 11, a flow of the internal processing of the collision alarm apparatus for vehicles 21, at the time of executing the collision time calculation processing, will be explained below.

Figure 11:
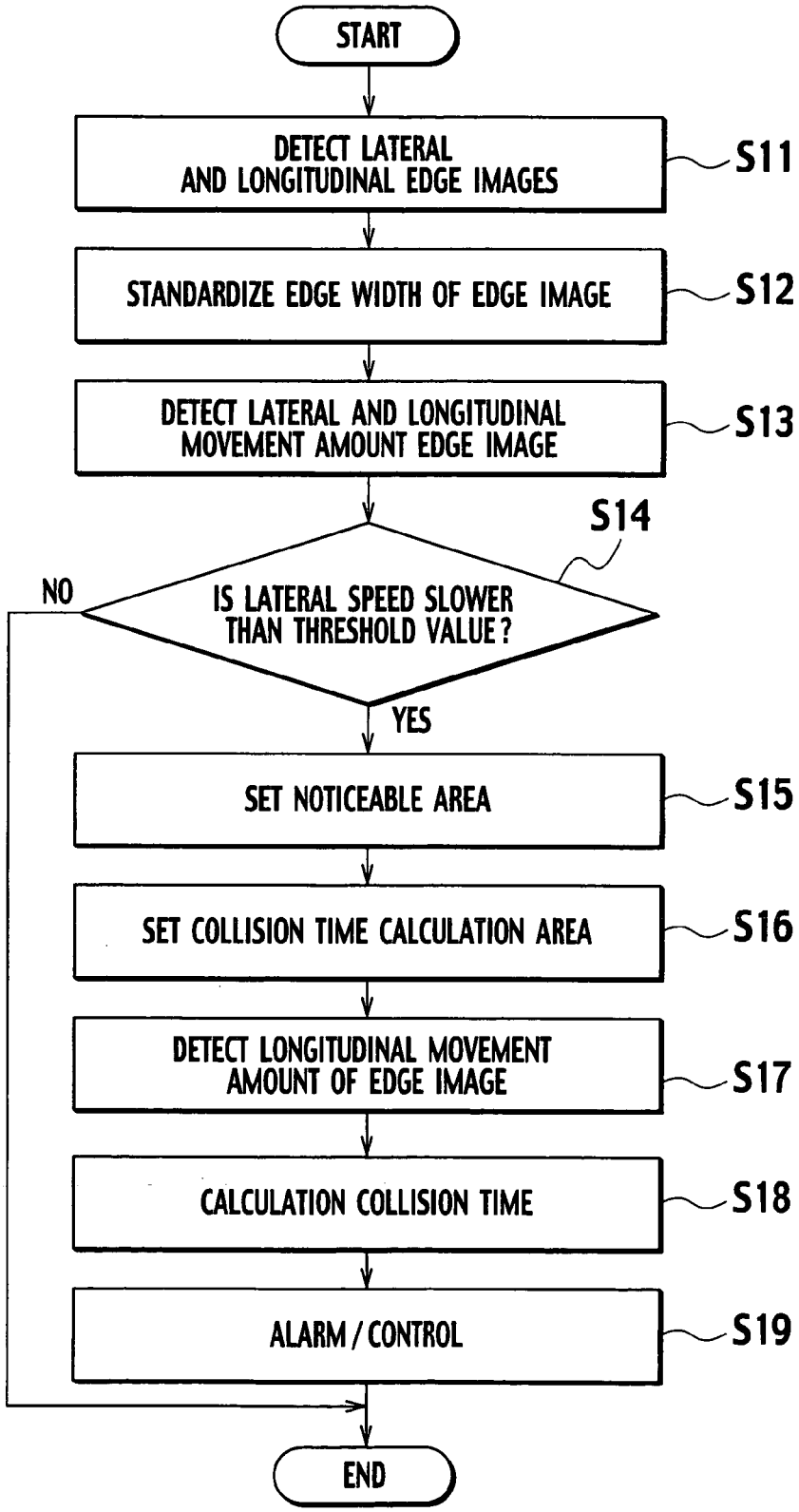
FIG. 11 is a flowchart showing a collision alarm processing flow according to the embodiment of the present invention.

The flowchart shown in FIG. 11 starts when the imaging means 22 picks up an image of the area around a vehicle at a predetermined frame rate and then inputs the picked up image of the area around the vehicle to the movement amount calculation means 23. The collision time calculation processing then proceeds to step S11.

At step S11, the lateral edge detection means 31 and the longitudinal edge detection means 32 detect a lateral edge image and a longitudinal edge image, respectively, from the image of the area around the vehicle picked up by the imaging means 22 by using a Sobel filter. The processing at step S11 is then completed, whereupon the calculation processing proceeds from step S11 to step S12.

At step S12, the lateral edge speed calculation means 33 and the longitudinal edge speed calculation means 34 standardize the lateral edge image and the longitudinal edge image, respectively, which are detected at step S11. This edge standardization processing is the same as that executed by the edge width standardization means 4 of the collision time estimation apparatus for vehicles 1, so the detailed explanation thereof will be omitted. The processing at step S12 is then completed, whereupon the calculation processing proceeds from step S12 to step S13.

At step S13, the lateral edge speed calculation means 33 and the longitudinal edge speed calculation means 34 each increment the value of a memory address (count value) corresponding to a position at which the standardized edge image is observed, and also reset the value of a memory address corresponding to a position at which the standardized edge image is not observed. The lateral edge speed calculation means 33 and the longitudinal edge speed calculation means 34 then store information as to over how many frames the standardized edge image is successively observed, and calculate the moving speed and the moving direction of the lateral edge image and the longitudinal edge image which are extracted based on the gradient of the count values. This processing is the same as that performed by the counting means 5 of the collision time estimation apparatus for vehicles 1, so the detailed explanation thereof will be omitted. The processing at step S13 is then completed, whereupon the calculation processing proceeds from step S13 to step S14.

At step S14, the noticeable area setting means 35 determines whether there is an image area containing a longitudinal edge image whose lateral moving speed is a threshold value or below. When there is no image area containing a longitudinal edge image whose lateral moving speed is the threshold value or below as a result of the determination, a series of calculation processing steps end. On the other hand, when there is an image area containing a longitudinal edge image whose lateral moving speed is the threshold value or below, the noticeable area setting means 35 advances this calculation processing to step S15.

At step S15, the noticeable area setting means 35 sets the image area containing the longitudinal edge image whose lateral moving speed is the threshold value or below, as a noticeable area containing an object having the possibility of collision. For example, when another vehicle B running on an adjacent lane merges with a lane L on which a subject vehicle is running straight forward as shown in FIGS. 12A and 12B, the relative position between the subject vehicle A and the other vehicle B is generally as shown in FIGS. 13A and 13B, and when there is a possibility of collision, the other vehicle B is approaching the subject vehicle A. When a camera is mounted so that the front of the subject vehicle (positive direction of z-axis) is the center of the visual line, however, the lateral movement amount (x-axis direction) of the other vehicle B between frames is small, and becomes extremely small particularly near the center of the visual line.

In addition, the movement amount of the other vehicle B between frames is not necessarily zero because the other vehicle B has a breadth (if the movement amount between frames is zero, the other vehicle B collides with the camera). This movement amount of the other vehicle B gradually increases as it moves to the periphery of the image. The noticeable area setting means 35 therefore provides a profile as shown in FIG. 14 by defining moving speeds (movement amount T(x), threshold value) at every lateral position (x), and sets, as a noticeable area, an image area containing a longitudinal edge image which has a lateral moving speed within this profile region. The processing at step S15 is then completed, whereupon the calculation processing proceeds from step S15 to step S16.

At step S16, the collision time calculation are a setting means 36 expands the longitudinal edge image contained in the noticeable area by a predetermined number of pixels (e.g., 10 pixels for both sides of the edge) thereby setting a collision time calculation area. The processing at step S16 is then completed, whereupon the calculation processing proceeds from step S16 to S17.

At step S16, the collision time calculation area setting means 36 may also define the size of the collision time calculation area according to a density gradient (edge strength) of the longitudinal edge image. In general, the lateral edge image and the longitudinal edge image represent density gradients in a longitudinal direction and a lateral direction, respectively, of an original image, and the edge strengths of these edge images (edge strength has + or − sings, but is considered herein as the absolute values of values obtained by spatial differentiation of the original image for simplicity) are proportional to the density gradient of an original image. That is, when the density gradient of the original image is small, the edge strength of the edge image is low as shown in FIGS. 15A to 15C, and when the density gradient of the original image is large, the edge strength of the edge image is high as shown in FIGS. 16A to 16C. On the other hand, when the density gradient is small, the dispersion of edge strength of the edge image is large, and when the density gradient is large, the dispersion of edge strength of the edge image is small.

This means that the density gradient of an original image and the dispersion of edge strength are in inverse proportional relation in which a blurred edge is seen where the dispersion of edge strength is large and a sharp edge is seen where the dispersion of edge strength is small. When an edge is blurred, there is a possibility that a portion used for measuring the longitudinal moving speed cannot be observed in the periphery of an edge image which is set as a noticeable area at the processing described later. Therefore, the collision time calculation area is set relatively large where the dispersion of edge strength is large, and is set relatively small where the dispersion of edge strength is small. This can prevent an unnecessary increase in processing time and degradation in calculation accuracy of the collision time.

Furthermore, at step S16, the collision time calculation area setting means 36 desirably sets the collision time calculation area by increasing the size of the noticeable area according to the lateral moving speed of the longitudinal edge image. With this configuration, when the lateral moving speed of the longitudinal edge is fast, a portion of the lateral edge image where the longitudinal moving speed is measurable can be contained in the collision time calculation area by setting this calculation area large. On the other hand, when the lateral moving speed of the longitudinal edge is slow, the size of the collision time calculation area is not unnecessarily increased, thereby preventing an unnecessary increase in processing time and degradation in calculation accuracy of the collision time.

When the lateral edge from which the longitudinal moving speed is detectable cannot be contained in the noticeable area by increasing the size of the noticeable area according to the density gradient (edge strength) or the lateral moving speed of the longitudinal edge image, the collision time calculation area setting means 36 desirably increases the size of the noticeable area until it contains a portion of the lateral edge image where the longitudinal moving speed is detectable. With this processing, the case where the longitudinal moving speed of the lateral edge image and the collision time cannot be calculated, can be eliminated.

At step S17, the movement amount calculation means 23 calculates the longitudinal position and the moving speed of the lateral edge image contained in the collision time calculation area. The processing at step S17 is then completed, whereupon the calculation processing proceeds from step S17 to step S18.

At step S18, the collision time calculation means 25 calculates the time-to-collide (TTC) with an object having the possibility of collision, based on the longitudinal position and the moving speed of the lateral edge image contained in the collision time calculation area. This processing is the same as that executed by the collision time calculation means 7 of the collision time estimation apparatus for vehicles 1, so the detailed explanation thereof will be omitted. The processing at step S18 is then completed, whereupon the calculation processing proceeds from step S18 to step S19.

At step S19, the alarm/control means 26 raises an alarm to alert a driver to a possible collision or controls a vehicle actuator to avoid the possible collision, according to the time-to-collide (TTC) calculated by the collision time calculation means 25. In consideration of human reaction time, the alarm/control means 26 desirably sets the collision time to several seconds. By this setting, a driver is appropriately informed of the possible collision without causing operational delay of the driver. When the collision time is as short as 100 ms and therefore is determined that operational delay of a driver is likely to occur, the alarm/control means 26 raises an alarm for the driver as well as automatically controls a throttle actuator, a brake actuator, and a steering actuator, thereby avoiding the collision with an object or reducing the collision speed. The processing at step S19 is then completed, whereupon a series of calculation processing steps end.

As is clear from the above description, according to the collision alarm apparatus for vehicles 21 in the embodiment of the present invention, the imaging means 22 picks up an image of the area around a vehicle, the movement amount calculation means 23 extracts a longitudinal edge image and a lateral edge image from the image picked up by the imaging means 22 and calculates the movement amount of the longitudinal and lateral edge images, the information extraction means 24 extracts an image area containing an object having the possibility of collision as a noticeable area according to the calculation result of the movement amount calculation means 23, the collision time calculation means 25 calculates the time of collision with the object by utilizing the longitudinal position and the moving speed of the lateral edge which is contained in the noticeable area extracted by the information extraction means 24, and the alarm/control means 26 raises an alarm to alert to a possible collision or controls the vehicle so as to avoid the possible collision according to the collision time calculated by the collision time calculation means 25. Accordingly, only the collision time between a subject vehicle and an object which may collide therewith can be calculated efficiently.

Furthermore, according to the collision alarm apparatus for vehicles 21 in the embodiment of the present invention, the imaging means 22 picks up an image at time intervals faster than the moving speed of an object, so that the longitudinal and lateral moving speeds can easily be calculated, thereby greatly reducing the computational complexity.

Moreover, according to the collision alarm apparatus for vehicles 21 in the embodiment of the present invention, the information extraction means 24 extracts as a noticeable area, an image area containing a longitudinal edge image whose lateral moving speed is slower than a predetermined value. Therefore, an area which may collide with a subject vehicle can be distinguished from an area which may not collide with the subject vehicle.

Furthermore, according to the collision alarm apparatus for vehicles 21 in the embodiment of the present invention, the collision time calculation area setting means 36 increases the size of the noticeable area by expanding the longitudinal edge image by a predetermined number of pixels and sets the increased noticeable area as a collision time calculation area, and the collision time calculation means 25 calculates the collision time by utilizing the longitudinal position and the moving speed of the lateral edge image which is contained in the collision time calculation area. Therefore, the lateral edge image from which the longitudinal position and the moving speed are detectable is more certainly contained in the collision time calculation area, which leads to more accurate calculation of the time of collision with an object which may collide with a vehicle.

Furthermore, according to the collision alarm apparatus for vehicles 21 in the embodiment of the present invention, the collision time calculation area setting means 36 increases or reduces the size of the noticeable area according to the density gradient of the longitudinal edge image which is contained in the noticeable area, and sets the increased or reduced noticeable area as a collision time calculation area, so that the collision time calculation area can be properly set without depending on the edge strength of an edge image.

Furthermore, according to the collision alarm apparatus for vehicles 21 in the embodiment of the present invention, the collision time calculation area setting means 36 increases or reduces the size of the noticeable area according to the lateral moving speed of the longitudinal edge which is contained in the noticeable area, and sets the increased or reduced noticeable area as a collision time calculation area, so that the collision time calculation area can be properly set without depending on the moving speed of an edge image.

Furthermore, according to the collision alarm apparatus for vehicles 21 in the embodiment of the present invention, when the noticeable area does not contain a lateral edge image from which the longitudinal position and the moving speed are detectable, the collision time calculation area setting means 36 increases the size of the noticeable area until it contains a lateral edge image having a predetermined density variation, and sets the increased noticeable area as a collision time calculation area, thereby improving detection accuracy of the moving speed.

Furthermore, according to the collision alarm apparatus for vehicles 21 in the embodiment of the present invention, the alarm/control means 26 sets timing of raising an alarm or controlling a vehicle according to the collision time, so that unnecessary time until raising the alarm to a driver or controlling a vehicle actuator can be eliminated.

In the above embodiment, the movement amount is calculated easily by increasing the frame rate sufficiently. However, the conventional techniques such as template matching or a gradient method can be used to calculate the movement amount as long as no particular concern is given for an increase in computational complexity. Specifically, when template matching is used to calculate the movement amount, a template of a tracking area W (the size of uxv) is set within an image acquired at time t−n (n=1, 2, 3, . . . ), and the position in an image acquired at time t, which most completely matches the set tracking area W, is specified by using a correlation value of normalized correlation or an evaluation function of SAD values. In the case of the normalized correlation, the correlation value ranges from 0 to 1, and becomes 1 when the degree of matching is the highest and approaches 0 as the degree of matching decreases. On the other hand, the SAD value is represented by the sum of the absolute values of differences in pixel values between the tracking area W that is set at time t−n and the noticeable area (area to which the template W is applied) at time t, and becomes smaller as the degree of matching increases. With respect to the position (x, y) noticed at time t−n, a peripheral pixel area containing this position (x, y) is set within the image acquired at time t, and a calculation is made as to where the area W set at time t−n moves at time t, by using the correlation values calculated at each point in the area S or the evaluation function. The movement amount can thus be calculated. The movement amount can be calculated in units of less than one pixel by using a sub-pixel technique for performing curve interpolation of correlation value or evaluation function. On the other hand, when a gradient method is used to calculate the movement amount, a restrictive condition is added such that a motion vector spatially changes smoothly, for example, an evaluation function expressing the smoothness of speed is provided. By calculating parameters that derive the minimum or maximum evaluation function, the movement amount between images can be calculated.

The entire content of a Patent Application No. TOKUGAN 2004-275039 with a filing date of Sep. 22, 2004, and No. TOKUGAN 2004-278504 with a filing date of Sep. 24, 2004, is hereby incorporated by reference.

Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A collision time estimation apparatus for vehicles that is provided in a vehicle and estimates a time of collision with an object, comprising:

imaging means for picking up an image of an area around a vehicle;

edge extraction means for extracting an edge image from the image picked up by the imaging means;

edge width standardization means for standardizing an edge width of the edge image extracted by the edge extraction means;

counting means for incrementing a count value corresponding to a position where the edge image standardized by the edge width standardization means is detected, and also initializing a count value corresponding to a position where the edge image standardized by the edge width standardization means is not detected;

moving speed detection means for calculating a moving direction and moving speed of the edge image extracted by the edge extraction means based on an inclination of the count values; and collision time calculation means for calculating a time of collision with an object by utilizing the position and the moving speed of the edge image calculated by the moving speed detection means.

2. The collision time estimation apparatus for vehicles according to claim 1, wherein the imaging means is mounted on at least one of a front end, a rear end, and a side face of the vehicle, or at a position where a time of collision with an object should be calculated accurately.

3. The collision time estimation apparatus for vehicles according to claim 1, wherein the collision time calculation means classifies the object based on the calculated collision time.

4. A collision time estimation method for vehicles for estimating a time of collision with an object around a vehicle, comprising the steps of:

picking up an image of an area around a vehicle;

extracting an edge image from the picked up image;

standardizing an edge width of the extracted edge image;

incrementing a count value corresponding to a position where the standardized edge image is detected, and initializing a count value corresponding to a position where the standardized edge image is not detected;

calculating a moving direction and moving speed of the extracted edge image based on an inclination of the count values; and calculating a time of collision with an object by utilizing the calculated position and moving speed of the edge image.

5. A collision alarm apparatus for vehicles comprising:

imaging means for picking up an image of an area around a vehicle;

movement amount calculation means for extracting a longitudinal edge image and a lateral edge image from the image picked up by the imaging means and calculating a movement amount of the longitudinal edge image and the lateral edge image;

information extraction means for extracting an image area containing an object having a possibility of collision as a noticeable area, according to a result of the calculation of the movement amount calculation means;

collision time calculation means for calculating a time of collision with the object by utilizing a longitudinal position and moving speed of the lateral edge image that is contained in the noticeable area extracted by the information extraction means; and alarm control means for raising an alarm for a possible collision or controlling the vehicle to avoid the possible collision according to the collision time calculated by the collision time calculation means.

6. The collision alarm apparatus for vehicles according to claim 5, wherein the imaging means picks up an image at time intervals faster than the moving speed of an object.

7. The collision alarm apparatus for vehicles according to claim 5, wherein the information extraction means extracts as the noticeable area, an image area containing the longitudinal edge image whose lateral moving speed is slower than a predetermined value.

8. The collision alarm apparatus for vehicles according to claim 5, wherein the information extraction means includes collision time calculation area setting means for increasing the size of the noticeable area by expanding the longitudinal edge image by a predetermined number of pixels and then setting the increased noticeable area as a collision time calculation area, and the collision time calculation means calculates the collision time by utilizing the longitudinal position and the moving speed of the lateral edge image that is contained in the collision time calculation area.

9. The collision alarm apparatus for vehicles according to claim 8, wherein the collision time calculation area setting means increases or reduces the size of the noticeable area according to a density gradient of the longitudinal edge image contained in the noticeable area, and sets the increased or reduced noticeable area as the collision time calculation area.

10. The collision alarm apparatus for vehicles according to claim 8, wherein the collision time calculation area setting means increases or reduces the size of the noticeable area according to the lateral moving speed of the longitudinal edge image contained in the noticeable area, and sets the increased or reduced noticeable area as the collision time calculation area.

11. The collision alarm apparatus for vehicles according to claim 8, wherein, when the noticeable area does not contain the lateral edge image where the longitudinal position and the moving speed are detectable, the collision time calculation area setting means increases the size of the noticeable area until the noticeable area contains a lateral edge image having a predetermined density variation, and sets the increased noticeable area as the collision time calculation area.

12. The collision alarm apparatus for vehicles according to claim 5, wherein the alarm control means sets timing of raising an alarm or controlling the vehicle according to the collision time.

13. A collision alarm method for vehicles comprising the steps of:

picking up an image of an area around a vehicle;

extracting a longitudinal edge image and a lateral edge image from the picked up image and calculating a movement amount of the longitudinal edge image and the lateral edge image;

extracting an image area containing an object having a possibility of collision as a noticeable area according to a result of the calculation of the movement amount;

calculating a time of collision with the object by utilizing a longitudinal position and moving speed of the lateral edge image that is contained in the extracted noticeable area; and raising an alarm for a possible collision or controlling the vehicle so as to avoid the possible collision according to the calculated collision time.

* * * * *